US009908350B2

(12) United States Patent
Katayama et al.

(10) Patent No.: US 9,908,350 B2
(45) Date of Patent: Mar. 6, 2018

(54) PRINTER

(71) Applicant: SATO HOLDINGS KABUSHIKI KAISHA, Tokyo (JP)

(72) Inventors: Tamotsu Katayama, Saitama (JP); Kenji Hirose, Saitama (JP)

(73) Assignee: SATO HOLDINGS KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/302,726

(22) PCT Filed: Apr. 8, 2015

(86) PCT No.: PCT/JP2015/060946
§ 371 (c)(1),
(2) Date: Oct. 7, 2016

(87) PCT Pub. No.: WO2015/156310
PCT Pub. Date: Oct. 15, 2015

(65) Prior Publication Data

US 2017/0036469 A1 Feb. 9, 2017

(30) Foreign Application Priority Data

Apr. 10, 2014 (JP) ..... 2014-081217

(51) Int. Cl.
*B41J 29/02* (2006.01)
*B41J 2/32* (2006.01)
*B41J 3/407* (2006.01)
*B41J 15/04* (2006.01)
*B41J 11/04* (2006.01)

(52) U.S. Cl.
CPC ..... *B41J 29/02* (2013.01); *B41J 2/32* (2013.01); *B41J 3/4075* (2013.01); *B41J 11/04* (2013.01); *B41J 15/042* (2013.01)

(58) Field of Classification Search
CPC . B41J 2/32; B41J 3/4075; B41J 15/042; B41J 2/325; B41J 11/42; B41J 11/04; B41J 15/046; B41J 11/425; B41J 15/02; B41J 15/18; B41J 17/02; B41J 17/32
See application file for complete search history.

(56) References Cited

FOREIGN PATENT DOCUMENTS

| | | | |
|---|---|---|---|
| JP | 09-267533 | A | 10/1997 |
| JP | 2005-035180 | A | 2/2005 |
| JP | 2005-133755 | A | 5/2005 |
| JP | 2006-312321 | A | 11/2006 |

*Primary Examiner* — Lamson Nguyen
(74) *Attorney, Agent, or Firm* — Foley & Lardner LLP

(57) ABSTRACT

The printer in the exemplary embodiment includes a functional unit Y. The functional unit Y includes: an opening and closing cover 3; a platen roller 10; a thermal head 28, a control board unit 40 and a battery container 33. The functional unit Y is accommodated in a body case. A front cover 5 is fixed to a body case 2. The front cover 5 enables the opening and closing cover 3 to be opened and closed, and protects the functional unit Y.

14 Claims, 12 Drawing Sheets

PRINTER

TECHNICAL FIELD

The present invention relates to a printer, for instance, a label printer configured to print desired information such as a character, a sign, a diagram, a bar code or so forth on a label temporarily attached to a paper mount.

BACKGROUND

A label printer is a type of printer exclusively for label printing. For example, the label printer is configured to rotate a platen roller while a continuous paper wound in a roll shape is pinched at one lengthwise end thereof between the platen roller and a thermal head, whereby the continuous paper is released therefrom in a sheet shape and is then fed through a paper path. During feeding of the continuous paper, the label printer is configured to cause the thermal head to print desired information on each of a plurality of labels temporarily attached to a long strip of a paper mount composing part of the continuous paper.

The label printer has two types of ejection modes, i.e., continuous ejection and separation ejection. Continuous ejection refers to a mode in which a label is ejected while being temporarily attached to the paper mount. Separation ejection refers to a mode in which a label is ejected after separated from the paper mount.

In continuous ejection, a paper mount to which a necessary number of labels are attached can be prepared by cutting processing, and then the labels can be separated from the paper mount and be attached to objects on site. Hence, this mode is suitable for a situation where the objects to which the labels are to be attached are located away from the printer. longitudinal On the other hand, in separation ejection, the labels are discharged one by one while being separated from the paper mount. Hence, this mode is suitable for a situation where objects to which the labels are to be attached are located near a worker. In performing separation ejection, a separation unit mounted to the printer is set in a separation ejection position, and simultaneously, one lengthwise end of the paper mount is folded about a separation pin and is then pinched between the platen roller and a nip roller of the separation unit. With the setting, when the continuous paper is fed for a printing purpose by rotating the platen roller, the paper mount is configured to be fed while being pinched between the platen roller and the nip roller, whereas printed labels are configured to be separated from the paper mount and be discharged outside the printer one by one.

Now, mobility is demanded for the above configured printer whereby the labels can be quickly ejected on an as-needed basis. Hence, the printer is required to be compact in size.

It should be noted that Japan Laid-open Patent Application Publication No. 2005-035180 discloses a technology to obtain a printer with mobility by enabling a printing device and a feeder unit to be attached to and detached from each other.

SUMMARY OF THE INVENTION

Technical Problem

Incidentally, in attempting to achieve compactness in size of the printer, it is required to assemble a large number of small components. This results in degradation in workability in assembling the components.

On the other hand, good positional accuracy is required among constituent components of the printer in order to obtain good printing quality. However, when the constituent components are produced in small sizes, it becomes difficult to achieve good positional accuracy.

The present invention has been conceived in view of the aforementioned technical background, and is intended to provide a technology whereby workability in assembling a printer can be enhanced.

Additionally, the present invention has been conceived in view of the aforementioned technical background, and is intended to provide a technology whereby good positional accuracy can be achieved among constituent components of a printer.

Solution to Problem

A printer according to a first aspect of the present invention is a printer including a functional unit. The functional unit includes: a print medium container configured to contain a print medium; a feeding roller configured to feed the print medium; a print head configured to print on the print medium; a control board configured to control a motion of the feeding roller and a motion of the print head; an electric power supply container configured to contain an electric power supply for supplying an electric power to a driver of the feeding roller, the print head and the control board; and an opening and closing cover configured to open and close the print medium container.

A printer according to a second aspect of the present invention may include: a first housing configured to contain the functional unit, and a second housing that is fixed to the first housing. The second housing enables the opening and closing cover to be opened and closed, and protects the functional unit together with the first housing.

A printer according to a third aspect of the present invention may further include a carrier mount plate that is elastically deformable. The carrier mount plate is provided with a screw hole for fixing a printer carrier thereto and is fitted at both lengthwise ends thereof onto a frame of the functional unit.

In a printer according to a fourth aspect of the present invention, the first housing and the second housing interpose the functional unit therebetween, while the first housing and the second housing are fixed to each other through the frame by two screws respectively inserted into two first screw holes separately provided in two positions of the first housing and penetrating the frame. The first housing and the second housing are directly fixed to each other by two second screws inserted into two second screw holes separately provided in two positions of the first housing while interposing the functional unit therebetween. A plate piece provided on the frame makes contact with tips of guide bosses provided on the first housing, and a flange provided on the frame makes contact with a step formed on the opposite side of the print medium container in the first housing. The two guide bosses communicate with the two first screw holes to guide insertion directions of the two screws inserted into the two first screw holes, and the step has a height higher than surroundings thereof. Thereby, a gap between the first housing and the functional unit is defined.

Advantageous Effects

According to the present invention, the functional unit is obtained by attaching functional components (e.g., the opening and closing cover, the feeding roller, the print head, the control board, etc.) to the frame in assembling the printer. Hence, workability in assembling the printer is enhanced compared to gradually attaching the functional components to the first housing.

Additionally, according to the present invention, the functional components (e.g., the opening and closing cover, the feeding roller, the print head, the control board, etc.) are attached to the frame. On the other hand, when a printer is assembled by sequentially stacking functional components one on the other, positional accuracy deteriorates among the functional components due to cumulative tolerance of the functional components. Compared to this, good positional accuracy can be herein achieved among constituent components of the printer.

DESCRIPTION OF EMBODIMENTS

Figure 1A:
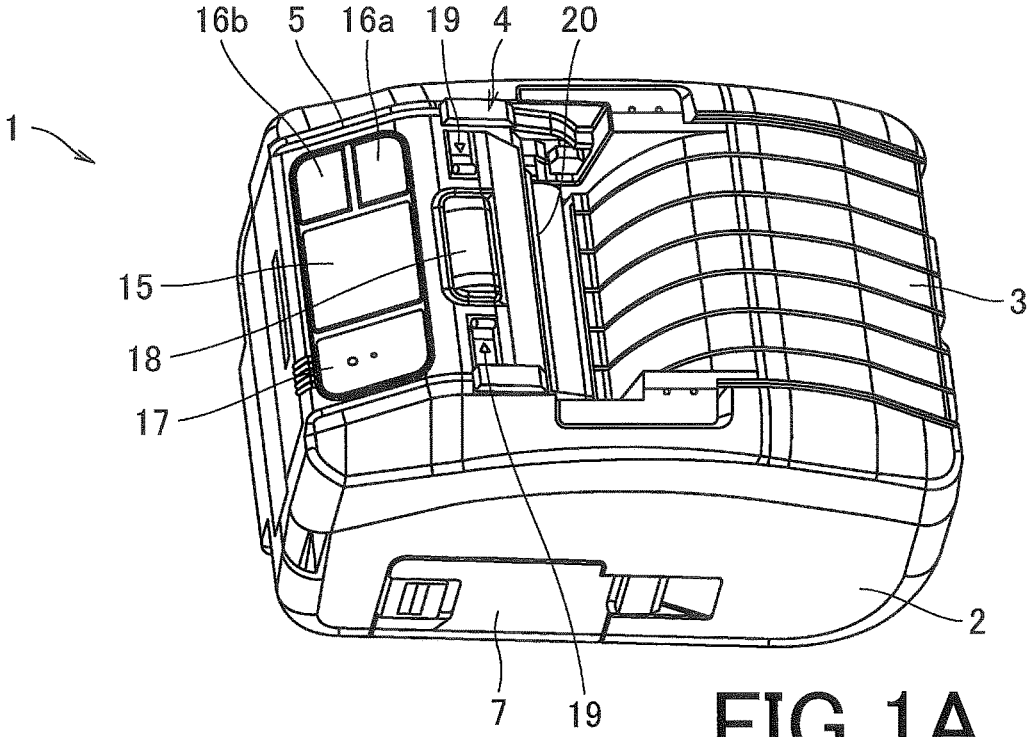
FIG. 1A is an entire perspective view of a printer according to an exemplary embodiment in a continuous ejection mode.

This application claims priority to Japanese Patent Application No. 2014-081217 filed on Apr. 10, 2014, the entirety of which is hereby incorporated by reference.

Based on drawings, an exemplary embodiment will be hereinafter explained in detail as an example of the present invention. It should be noted that in principle, the same constituent elements will be denoted by the same reference sign in the drawings for explaining the exemplary embodiment, and will not be explained repeatedly.

Figure 1B:
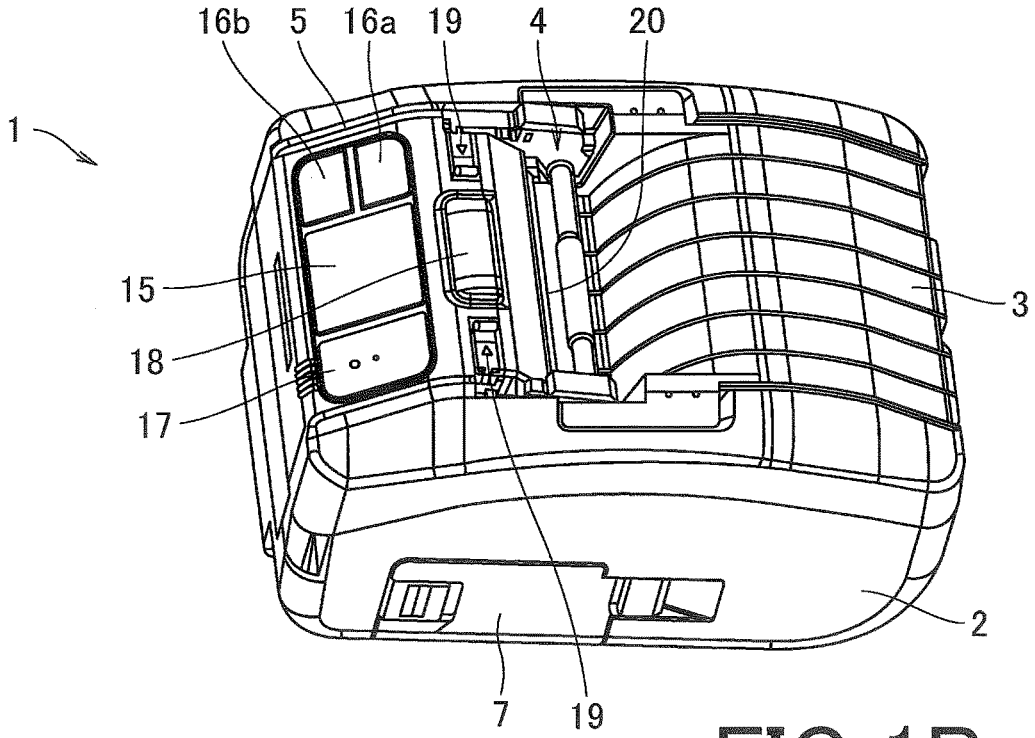
FIG. 1B is an entire perspective view of the printer according to the exemplary embodiment in a separation ejection mode.
Figure 2:
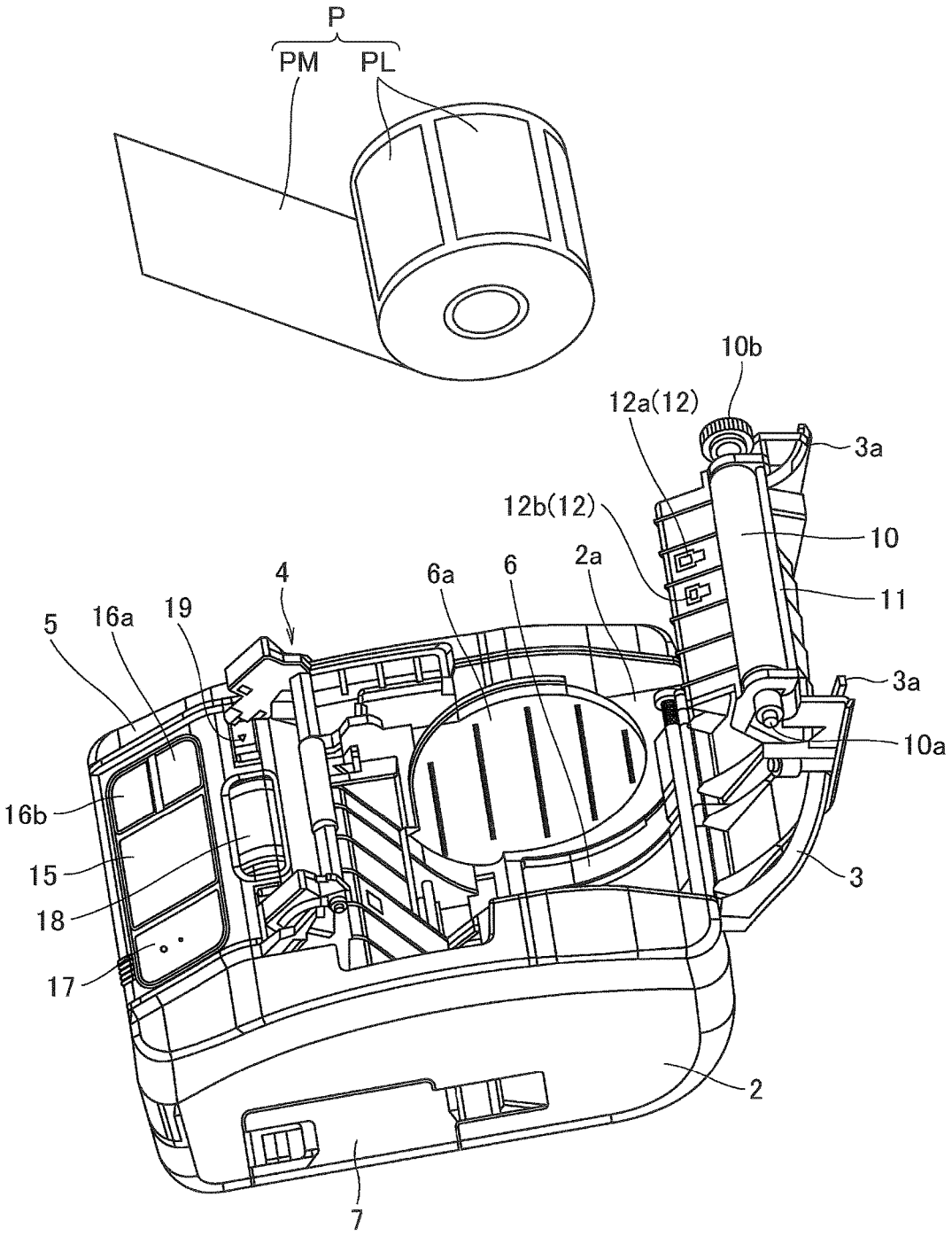
FIG. 2 is an entire perspective view of a continuous paper and the printer shown in FIG. 1A when an opening and closing cover is set in an opened state.
Figure 3:
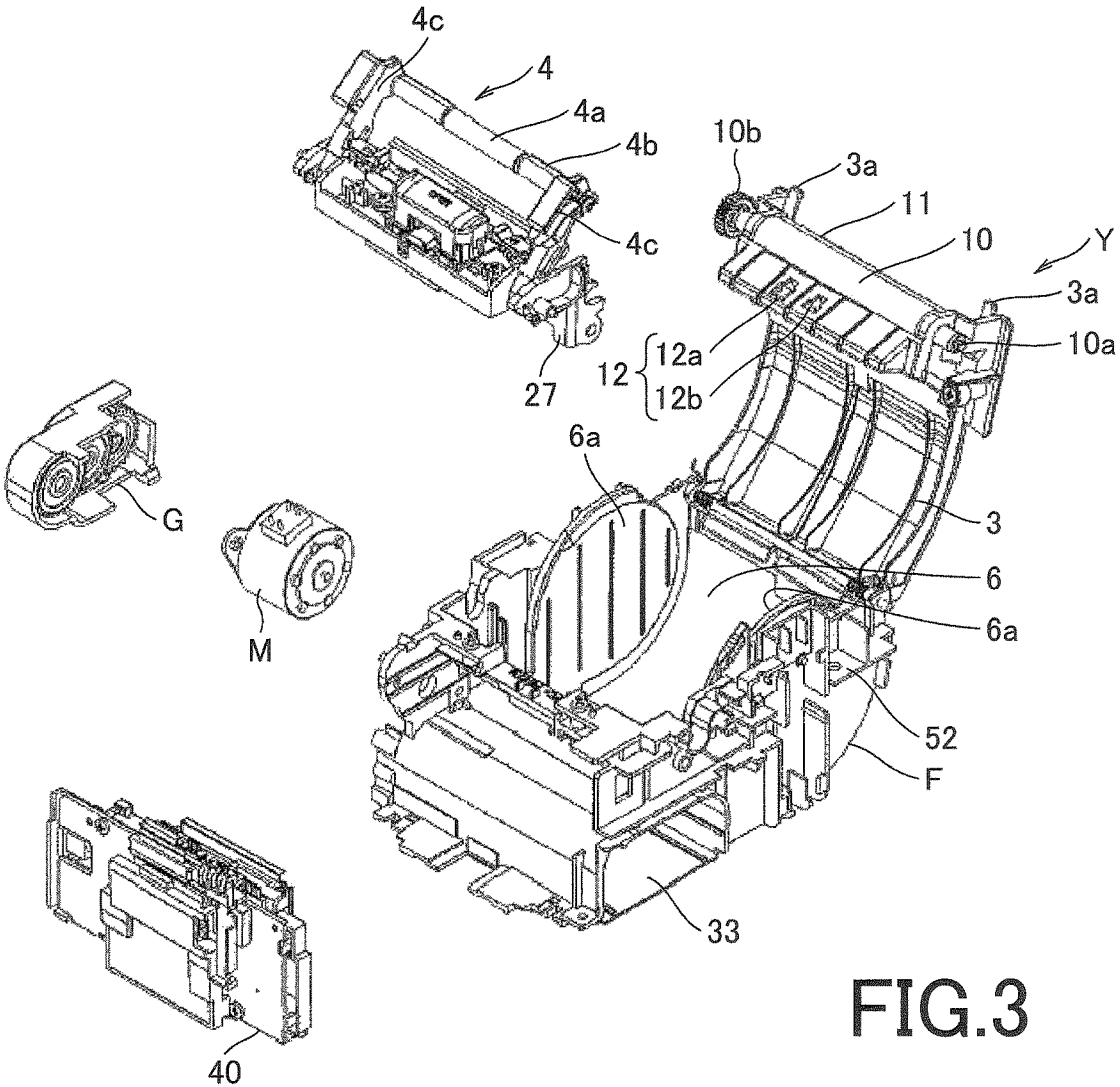
FIG. 3 is an exploded perspective view of a functional unit composing part of the printer shown in FIG. 1A.
Figure 4:
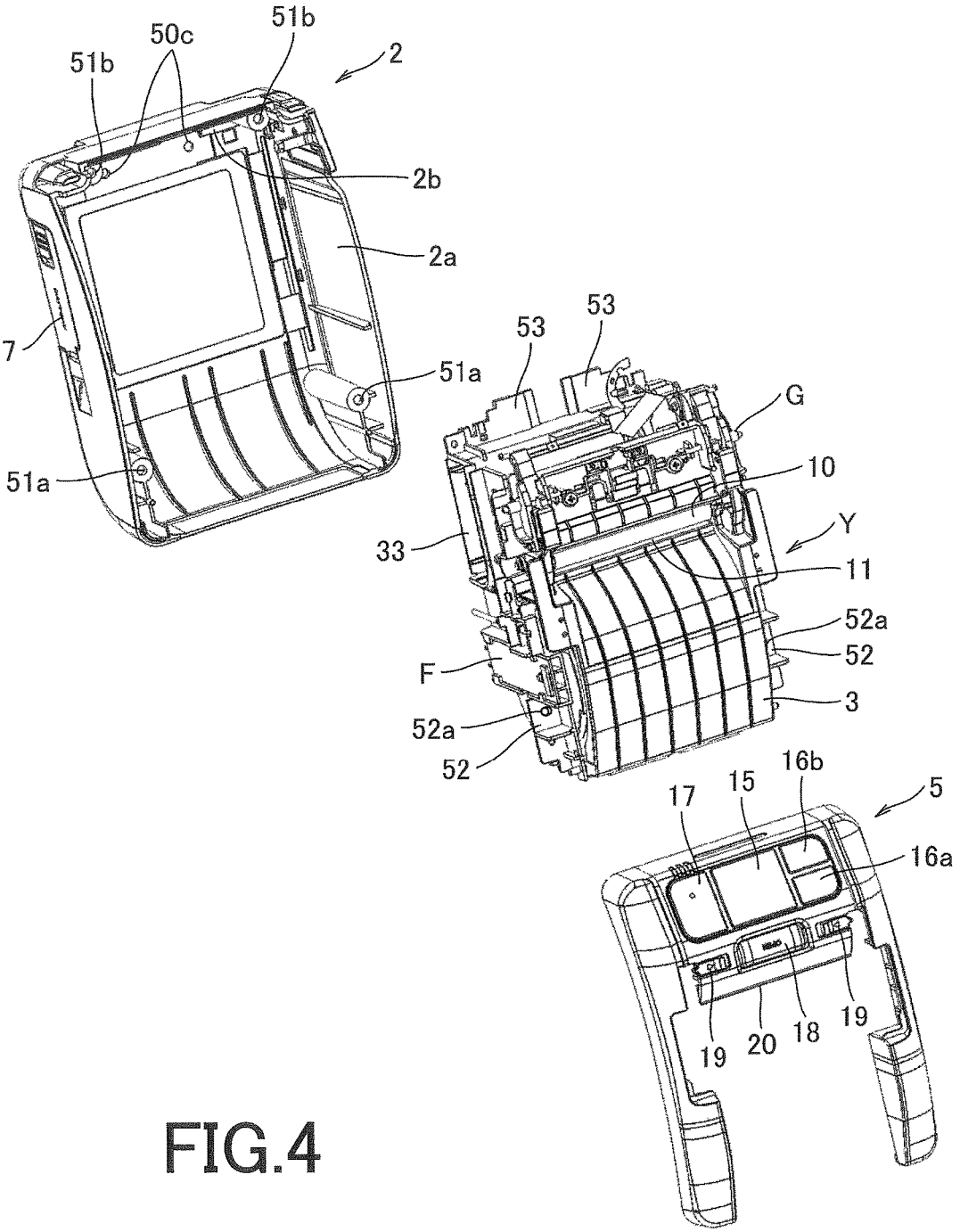
FIG. 4 is an exploded perspective view of a body case, a front cover and the functional unit of the printer shown in FIG. 1A.
Figure 5:
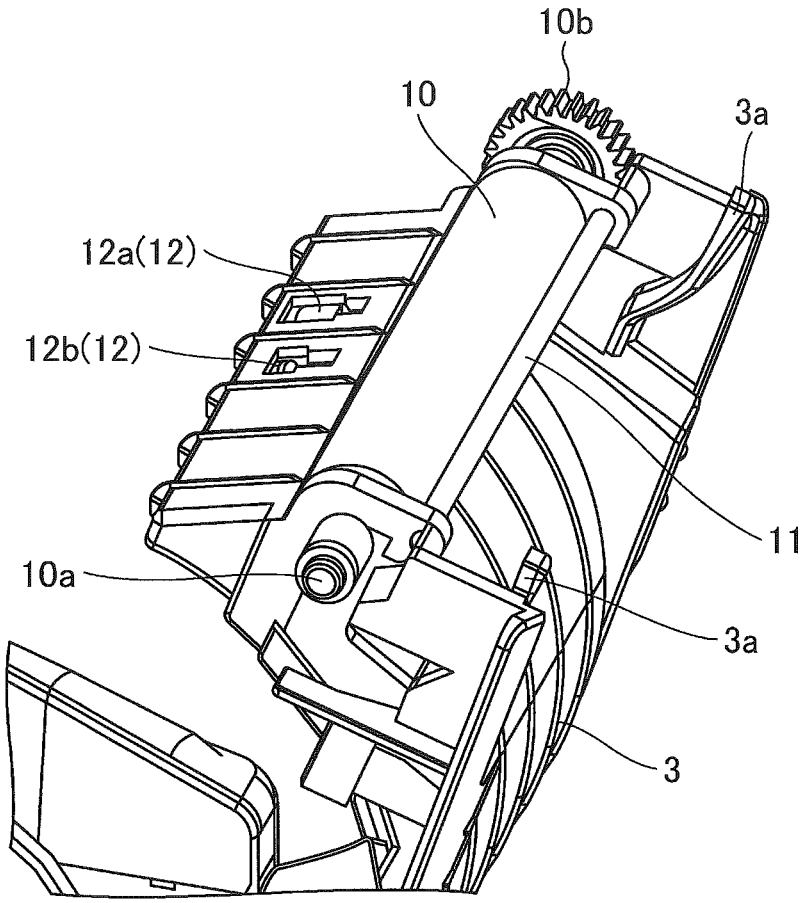
FIG. 5 is a perspective view of major elements of the opening and closing cover of the printer shown in FIG. 1A.

FIG. 1A is an entire perspective view of a printer according to the present exemplary embodiment in a continuous ejection mode. FIG. 1B is an entire perspective view of the printer according to the present exemplary embodiment in a separation ejection mode. FIG. 2 is an entire perspective view of a continuous paper and the printer shown in FIG. 1A when an opening and closing cover is set in an opened state. FIG. 3 is an exploded perspective view of a functional unit composing part of the printer shown in FIG. 1A. FIG. 4 is an exploded perspective view of a body case, a front cover and the functional unit of the printer shown in FIG. 1A. FIG. 5 is a perspective view of major elements of the opening and closing cover of the printer shown in FIG. 1A.

As shown in FIGS. 1A to 4, a printer 1 according to the present exemplary embodiment is a portable label printer made in a flat cuboid shape, for instance, and includes a body case 2 (exemplary first housing) and a front cover 5 (exemplary second housing) that are fixed to each other by screws. Additionally, a functional unit Y (to be described below in detail), constructed by attaching an opening and closing cover 3, a separation unit 4 (separation mechanism) and so forth to each other, is protected by the body case 2 and the front cover 5. The printer 1 is of a dual mode type configured to be capable of switching between continuous ejection and separation ejection by itself.

It should be noted that the printer 1 is not only usable with an ejection port facing upwards (in horizontal installation), but also usable with the ejection port facing sideward (in a vertically held position) by hooking a belt clip (not shown in the drawings) mounted to the bottom surface of the printer 1 (the back surface of the body case 2) on a belt of a worker or by attaching a shoulder belt (not shown in the drawings) to the printer 1 and then hanging the shoulder belt on the shoulder of the worker.

The body case 2 has a housing composing part of the contour of the printer 1, and as shown in FIG. 2, includes an opening 2*a* in one surface thereof. Additionally, the functional unit Y is accommodated in the opening 2*a*. It should be noted that as shown in FIGS. 1A, 1B and 2, a battery cover 7 is pivotably supported by one of the lateral surfaces of the body case 2, and can take an opened or closed position. The battery cover 7 is an opening and closing cover for a battery container 33 to be described (FIGS. 3 and 4).

As shown in FIG. 3, the functional unit Y includes a frame F in which a paper container 6 (exemplary print medium container) is formed to accommodate a continuous paper P (exemplary print medium) in a roll shape. Additionally, the opening and closing cover 3, a platen roller 10 (exemplary feeding roller), a thermal head 28 (exemplary printing head), a separation unit 4 (separation mechanism), a control board unit 40 (exemplary control board) and so forth are attached to the frame F. Moreover, the battery container 33 (electric power supply container) is built in the frame F to accommodate a battery (not shown in the drawings) as an electric power supply.

A paper guide 6*a* is herein installed in the interior of the paper container 6 built in the frame F. The paper guide 6*a* is a member for guiding feeding of the continuous paper P. The paper guide 6*a* makes contact with the both axial end surfaces of the continuous paper P in a roll shape whereby the continuous paper P is rotatably supported. The paper guide 6*a* is installed to be movable along the width direction of the continuous paper P such that its position can be changed in accordance with the width of the continuous paper P.

As shown in FIG. 2, the continuous paper P includes, for instance, a long strip of a paper mount PM and a plurality of labels PL that are temporarily attached to the paper mount PM along the lengthwise direction of the paper mount PM at predetermined intervals. The continuous paper P is wound in a roll shape and is accommodated in the paper container 6. A removing agent such as silicone is coated on a label attached surface of the paper mount PM, whereby the labels PL can be easily separated from the paper mount PM. Additionally, in order to indicate the locations of the labels PL, location detection marks (not shown in the drawings) are provided on the back side of the label attached surface of the paper mount PM while being aligned along the lengthwise direction of the paper mount PM at predetermined intervals. A thermosensitive color former layer is disposed on the front surface (printing surface) of each label PL, and is configured to turn a predetermined color (black, red, etc.) when reaching a predetermined temperature range.

The opening and closing cover 3 is an opening and closing cover for closing and opening the paper container 6. One lengthwise end of the opening and closing cover 3 (lengthwise middle of the frame F) is movable in directions separating from and approaching to the frame F, while the other lengthwise end thereof is pivotably supported by one lengthwise end of the frame F through a hinge or so forth. Additionally, the opening and closing cover 3 is urged in an opening direction (namely, a separating direction of the one lengthwise end of the opening and closing cover 3 from the frame F) by a torsion spring (see FIGS. 8 and 9) disposed on the other lengthwise end thereof.

As shown in FIGS. 2, 3 and 5, the one lengthwise end of the opening and closing cover 3 is provided with a pair of holding portions 3*a*. The pair of holding portions 3*a* is a pair of portions configured to press and fix the separation unit 4 in a separation ejection position when the opening and closing cover 3 is set in a closed state in performing separation ejection. The pair of holding portions 3*a* is provided on the both ends of the opening and closing cover 3 in the width direction (namely, a direction perpendicular to the lengthwise direction of the opening and closing cover 3).

Additionally, as shown in FIGS. 2 to 5, the platen roller 10 is rotatably supported by the one lengthwise end of the opening and closing cover 3 so as to be rotatable in normal and reverse directions. The platen roller 10 is feeding means for feeding the continuous paper P. A gear 10*b* is connected to one end of a platen roller shaft 10*a* of the platen roller 10. When the opening and closing cover 3 is set in the closed state, the gear 10*b* is configured to be engaged with a gear group G (FIG. 3) and be mechanically connected to a stepping motor M (FIG. 3) through the gear group G. The gear group G is mounted to one of the lateral surfaces of the frame F. The stepping motor M is an exemplary driver for driving a platen roller and is attached to the one of the lateral surfaces of the frame F similarly to the gear group G.

As shown in FIG. 5 in detail, a separation pin 11 is mounted to the one lengthwise end of the opening and closing cover 3 along and in the vicinity of the platen roller 10. The separation pin 11 is a separation member for separating the labels PL from the paper mount PM. The separation pin 11 is supported at the both lengthwise ends thereof by the opening and closing cover 3.

Additionally, as shown in FIGS. 2, 3 and 5, sensors 12 (12*a*, 12*b*) are mounted to a planar part of the one lengthwise end of the opening and closing cover 3. The planar part of the one lengthwise end of the open close cover 3 is configured to face a paper path when the opening and closing cover 3 is set in the closed state. The sensor 12*a* is a sensor for detecting the locations of the labels PL (location detection marks on the aforementioned paper mount PM), and is composed of, for instance, a reflective photosensor or so forth. On the other hand, the sensor 12*b* is a sensor for detecting whether or not the labels PL exist (a region between adjacent labels PL on the paper mount PM, etc.), and is composed of, for instance, a transmissive photosensor or so forth.

The separation unit 4 has a function of separating the labels PL from the paper mount PM in separation ejection and then dividing the feeding path of the continuous paper P into a feeding path for the paper mount PM and that for the labels PL. The separation unit 4 is mounted such that one lengthwise end thereof can be moved to a continuous ejection position located inside the printer 1 and a separation ejection position located outside the printer 1. It should be noted that the construction of the separation unit 4 will be described below.

As shown in FIGS. 1A, 1B, 2 and 4, the front cover 5 is fixed to the body case 2, covers a region opposed to the opening and closing cover 3 in the opening 2*a* of the body case 2, and also covers portions of the body case 2 that are located in the vicinity of the both lateral surfaces of the body case 2 corresponding to the both sides of the opening and closing cover 3, thereby enabling the opening and closing cover 3 to be opened and closed. The front cover 5 is provided with a display 15, operating buttons 16*a* and 16*b*, an electric power button 17, a cover open button 18, a pair of release levers 19 and a cutter 20.

The display 15 is a screen for displaying an operating command, a message and so forth, and is composed of, for instance, an LCD (Liquid Crystal Display). The operating buttons 16*a* and 16*b* are buttons for operating a motion of the printer 1, whereas the electric power button 17 is a button for turning on and off the electric power supply of the printer 1.

The cover open button 18 is a button for opening the opening and closing cover 3. The release levers 19 are members for holding the separation unit 4 in the continuous ejection position. When the release levers 19 are moved to approach each other, the holding state of the separation unit 4 is configured to be releasable.

The cutter 20 is a member for cutting the paper mount PM of the continuous paper P for which continuous ejection has been done. The cutter 20 is mounted to the tip of a part of the front cover 5, i.e., the tip of a part opposed to the opening and closing cover 3. It should be noted that an ejection port is produced between the opening and closing cover 3 and the front cover 5.

Figure 6:
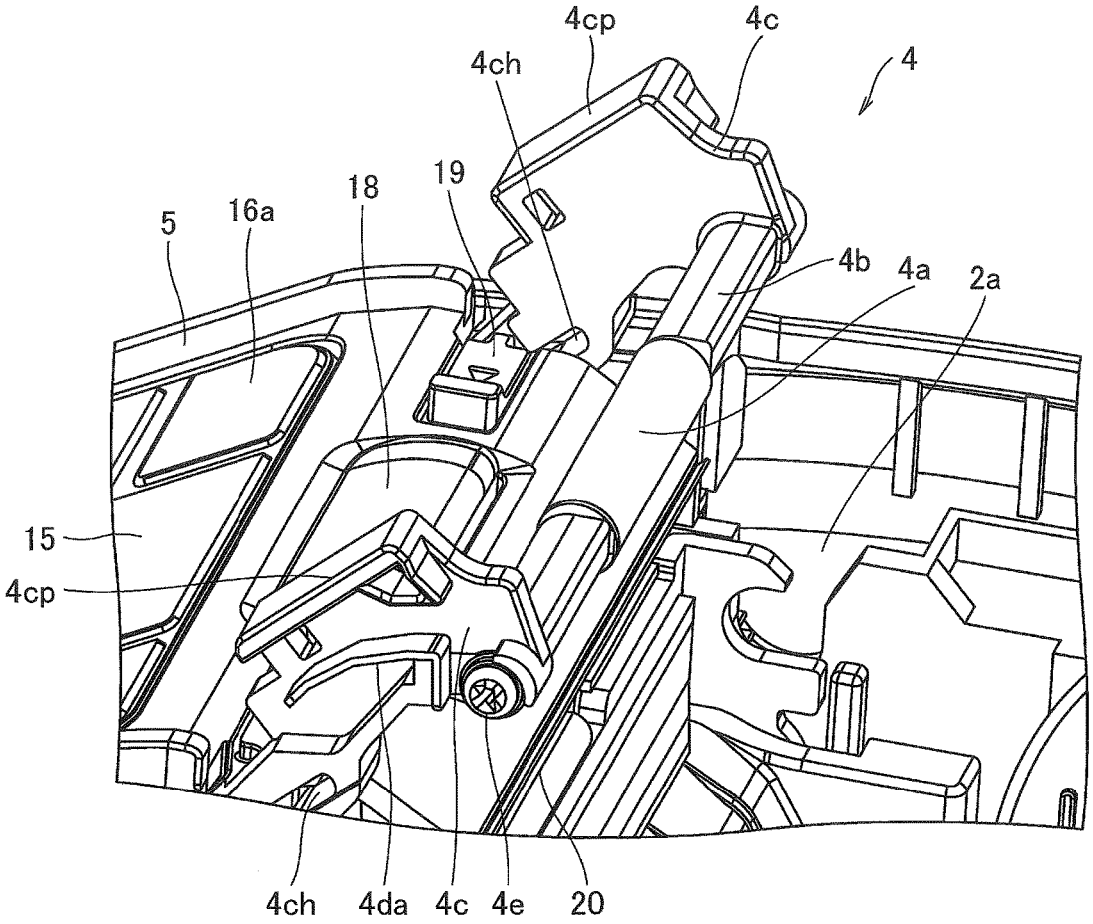
FIG. 6 is an enlarged perspective view of major elements of a separation unit and its surroundings in the printer shown in FIG. 2.
Figure 7:
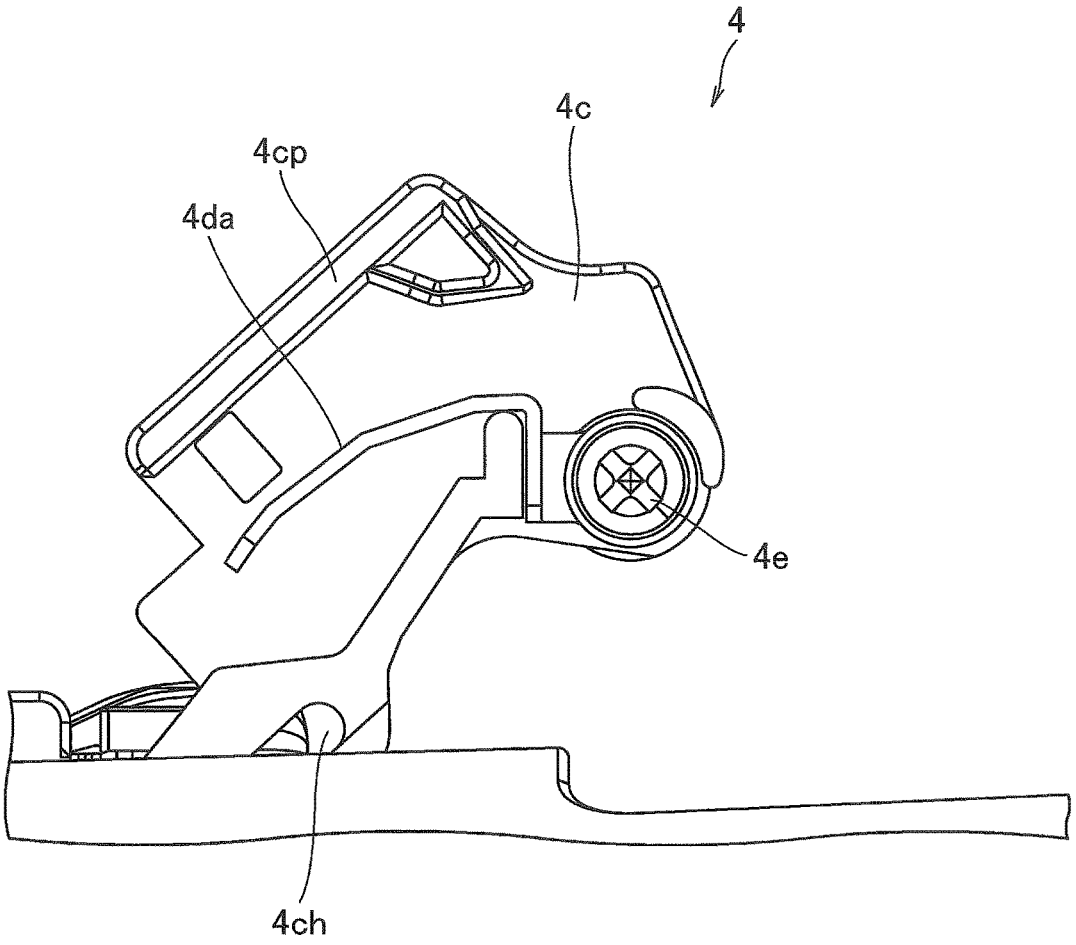
FIG. 7 is a side view of the separation unit shown in FIG. 6.

Next, the separation unit 4 will be explained with reference to FIGS. 6 and 7. FIG. 6 is an enlarged perspective view of major elements of the separation unit and its surroundings in the printer shown in FIG. 2. FIG. 7 is a side view of the separation unit shown in FIG. 6.

The separation unit 4 includes a nip roller 4*a*, a shaft 4*b*, a pair of support portions 4*c*, a pair of flat springs 4*da* and a screw 4*e*.

The nip roller 4*a* is a member disposed for feeding the paper mount PM inserted between the nip roller 4*a* and the platen roller 10 with the paper mount PM being pinched therebetween. In separation ejection, the nip roller 4*a* is configured to be rotated in contact with the platen roller 10 in conjunction with rotation of the platen roller 10. The nip roller 4*a* is made of, for instance, an elastic member such as rubber. The nip roller 4*a* is rotatably supported by the shaft 4*b* interposed and held between one lengthwise ends of the pair of support portions 4*c*. Additionally, the nip roller 4*a* has a length shorter than the entire length of the shaft 4*b*, and is disposed partially on the shaft 4*b*, i.e., on an axial middle part of the shaft 4*b*.

The pair of support portions 4*c* is a pair of members for supporting the nip roller 4*a* and the shaft 4*b*. Each support portion 4*c* is provided with an eave part 4*cp* on the upper part of the one lengthwise end thereof. The eave part 4*cp* extends outward from the lateral surface of each support portion 4*c*. Additionally, each support portion 4*c* is provided with a guide rail hole 4*ch* in the other lengthwise end thereof. Each guide rail hole 4*ch* is a hole for guiding and restricting movement of the separation unit 4, and is elongated along the lengthwise direction of each support portion 4*c*.

The pair of flat springs 4*da* is a pair of members configured to make contact with the holding portions 3*a* of the opening and closing cover 3 and urge the nip roller 4*a* toward the platen roller 10 when the opening and closing cover 3 is closed in performing separation ejection. Each flat spring 4*da* is fixed to the one lengthwise end-side part (nip roller 4*a*-side part) of the outer lateral surface of each support portion 4*c*, extends therefrom in a curved shape to the other lengthwise end (the guide rail hole 4*ch* side), and floats at its terminal end. It should be noted that each flat spring 4*da* is made of metal, for instance, and is detachably fixed by the screw 4*e*.

Figure 8:
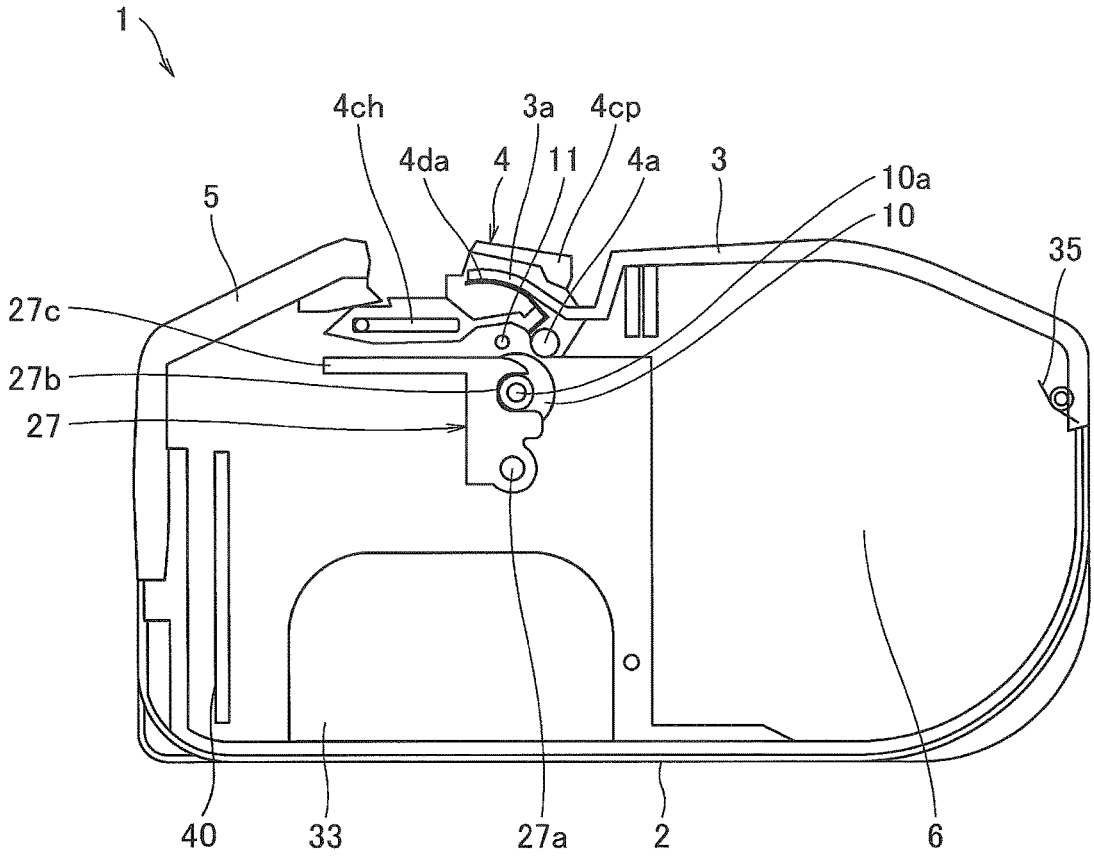
FIG. 8 is a schematic configuration diagram of the printer shown in FIG. 1B in the separation ejection mode and shows the interior of the printer from a lateral side in a transparent manner.

Next, the internal structure of the printer 1 will be explained with reference to FIG. 8. FIG. 8 is a schematic configuration diagram of the printer shown in FIG. 1A in the separation ejection mode and shows the interior of the printer from a lateral side in a transparent manner.

As shown in FIG. 8, the frame F accommodated in the opening 2*a* of the body case 2 includes a head bracket 27, the thermal head 28 (see FIGS. 12A and 12B), a coil spring 29 (see FIGS. 12A and 12B) and the battery container 33 as a mechanism for printing on the labels PL of the continuous paper.

The head bracket 27 is a member for holding the opening and closing cover 3 set in the closed state. The head bracket 27 is mounted to the aforementioned frame F. When the opening and closing cover 3 is set in the closed state, the head bracket 27 is configured to face the platen roller 10 while being able to swing about a pivot shaft 27*a*.

The head bracket 27 is provided with a groove 27*b*. When the platen roller shaft 10*a* of the platen roller 10 is fitted into the groove 27*b*, the opening and closing cover 3 is configured to be held by the head bracket 27.

Additionally, the head bracket 27 is provided with a press part 27*c*. The press part 27*c* is disposed in a position (immediately below and) opposed to the cover open button 18 shown in FIG. 1A. When the cover open button 18 is pressed, the press part 27*c* is also pressed and thereby the holding state of the opening and closing cover 3 by the head bracket 27 is configured to be released. When the holding state of the opening and closing cover 3 is herein released, the opening and closing cover 3 is configured to be automatically opened by an urging force of a torsion spring 35 disposed on the other lengthwise end thereof.

The thermal head 28 is printing means for printing information, for instance, a character, a sign, a diagram, a bar code or so forth on the labels PL. The thermal head 28 is mounted to the head bracket 27 through a circuit board 36 while a printing surface thereof faces the paper path. The thermal head 28 is configured to face the platen roller 10 when the opening and closing cover 3 is set in the closed state. A plurality of heating resistors (heating elements), configured to generate heat by electric conduction, are mounted to the printing surface of the thermal head 28 while being aligned along the width direction of the continuous paper P. It should be noted that the circuit board 36 is a wiring board configured to transmit a print signal to the thermal head 28.

The coil spring 29 (see FIGS. 12A and 12B) is a member mounted to the back surface of the head bracket 27 (that is, the back side of the surface to which the circuit board 36 is mounted). The coil spring 29 is configured to urge the head bracket 27 and the thermal head 28 toward the platen roller 10 when the opening and closing cover 3 is set in the closed state. The head bracket 27 is pressed toward the platen roller 10 by the urging force of the coil spring 29. Hence, the platen roller shaft 10*a*, which is fitted into the groove 27*b* of the head bracket 27, is also firmly pressed and thereby the holding state of the opening and closing cover 3 by the head bracket 27 is maintained.

The battery container 33 is a compartment in which a battery is accommodated. When the electric power button 17 is powered on after the battery has been accommodated in the battery container 33, the battery is connected to an electrode (not shown in the drawings). Electric power is then configured to be supplied to the stepping motor M, the thermal head 28, the control board unit 40 (to be described), the sensors 12, the display 15, the operating buttons 16*a* and 16*b* and so forth.

As shown in FIGS. 3 and 8, the control board unit 40 is attached to the frame F on the opposite side of the position to which the opening and closing cover 3 is attached. An electric board is mounted to the control board unit 40 in order to control a motion of the printer 1. In accordance with the content of an input operation by an operator using the operating buttons 16*a* and 16*b* and the information detected by the sensors 12, a variety of motions are configured to be controlled, including the rotational motion of the platen roller 10 through the stepping motor M, the printing motion of the thermal head 28 in printing on the labels PL, and so forth.

Thus, in the printer 1 of the present exemplary embodiment, the functional unit Y having a printing function is constructed as a module independent from a housing composed of the body case 2 and the front cover 5, and the body case 2 and the front cover 5 are fixed to each other while the functional unit Y is protected (interposed) therebetween.

Therefore, in assembling the printer 1, the functional unit Y can be obtained as a module by sequentially attaching the functional components (e.g., the opening and closing cover 3, the platen roller 10, the thermal head 28, the separation unit 4, the control board unit 40, etc.) to the frame F. In other words, the functional unit Y is fabricated as a completed unit by gradually attaching the functional components (e.g., the platen roller 10, etc.) to the frame F functioning as a base from various arbitrary directions.

On the other hand, when the body case 2 is used as a base, it is required to sequentially attaching the functional components to the interior of the body case 2 functioning as a box. This makes it difficult to assemble the printer 1. Compared to this, workability in assembling the printer 1 is enhanced in the present exemplary embodiment.

Moreover, in the printer 1 of the present exemplary embodiment, the functional components (e.g., the opening and closing cover 3, the platen roller 10, the thermal head 28, the separation unit 4, the control board unit 40, etc.) are thus attached to the frame F functioning as a base. In contrast with the present exemplary embodiment, if the printer 1 is assembled by sequentially stacking the functional components one on the other, positional accuracy will deteriorate among the functional components due to cumulative tolerance of the functional components. Compared to this, good positional accuracy can be achieved among constituent components of the printer 1 in the present exemplary embodiment.

Furthermore, in the printer 1 of the present exemplary embodiment, the functional unit Y is constructed by attaching the functional components (e.g., the opening and closing cover 3, the platen roller 10, etc.) to the frame F. Hence, the printing motion can be performed solely by the functional unit Y. For example, in the printer 1 of the present exemplary embodiment, the opening and closing cover 3 provided with the platen roller 10 is disposed in the functional unit Y, whereas the thermal head 28 is disposed to face the position in which the platen roller 10 is configured to be located when the opening and closing cover 3 is closed. Hence, the printing motion can be performed by switching between separation ejection and continuous ejection.

Therefore, motion check (test motion) in the manufacturing process of the printer 1 can be conducted before the printer 1 is obtained as a completed product. Hence, malfunctions in motion can be checked at this point of time, and countermeasures can be easily taken for the malfunctions.

Additionally, the battery container 33 is built in the frame F. Hence, the wiring length from the battery can be minimized.

Figure 9:
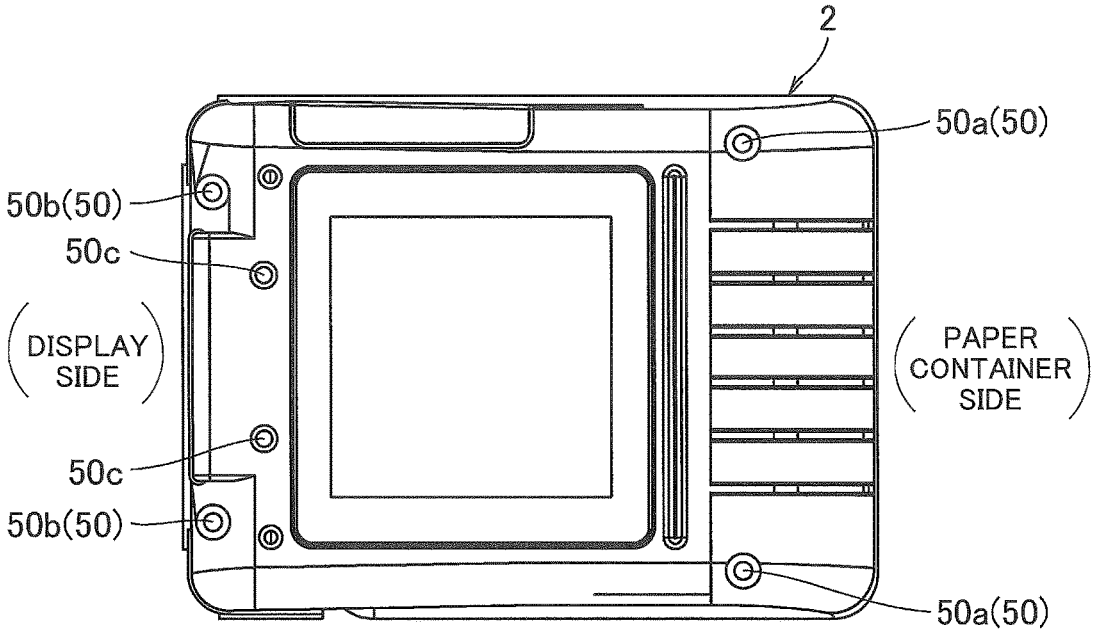
FIG. 9 is a bottom view of the body case of the printer shown in FIG. 1.
Figure 10:
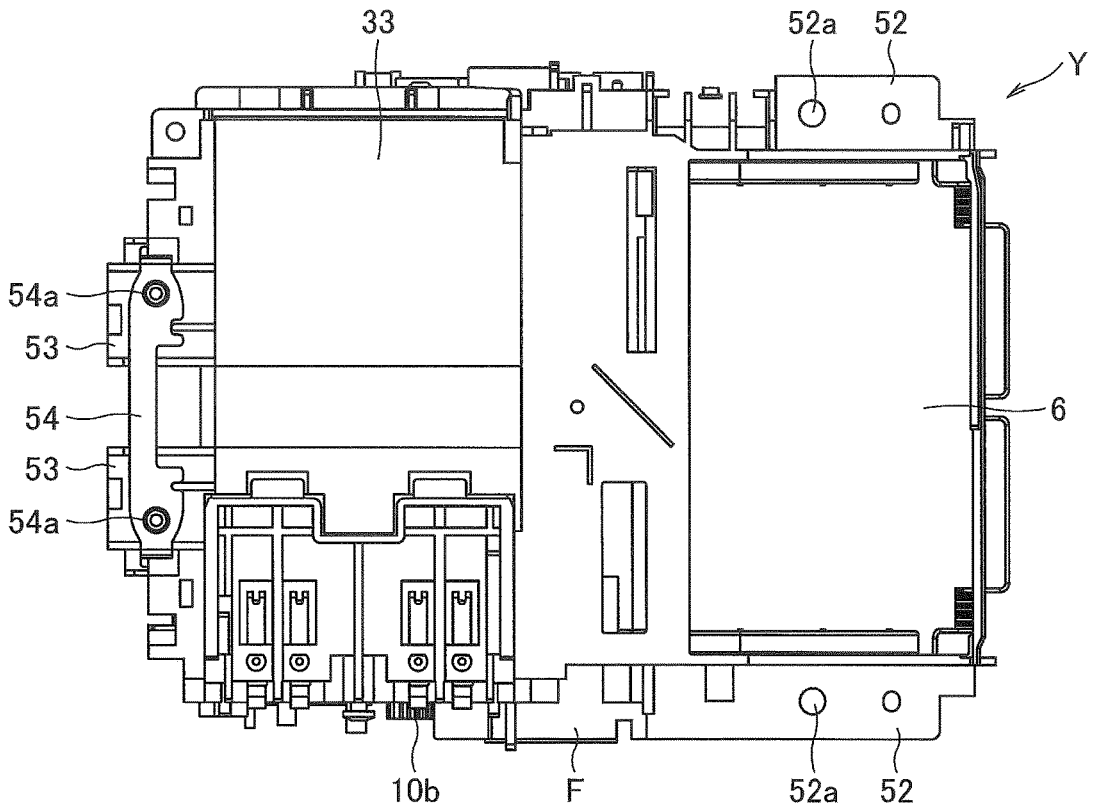
FIG. 10 is a bottom view of the functional unit of the printer shown in FIG. 1A.
Figure 11:
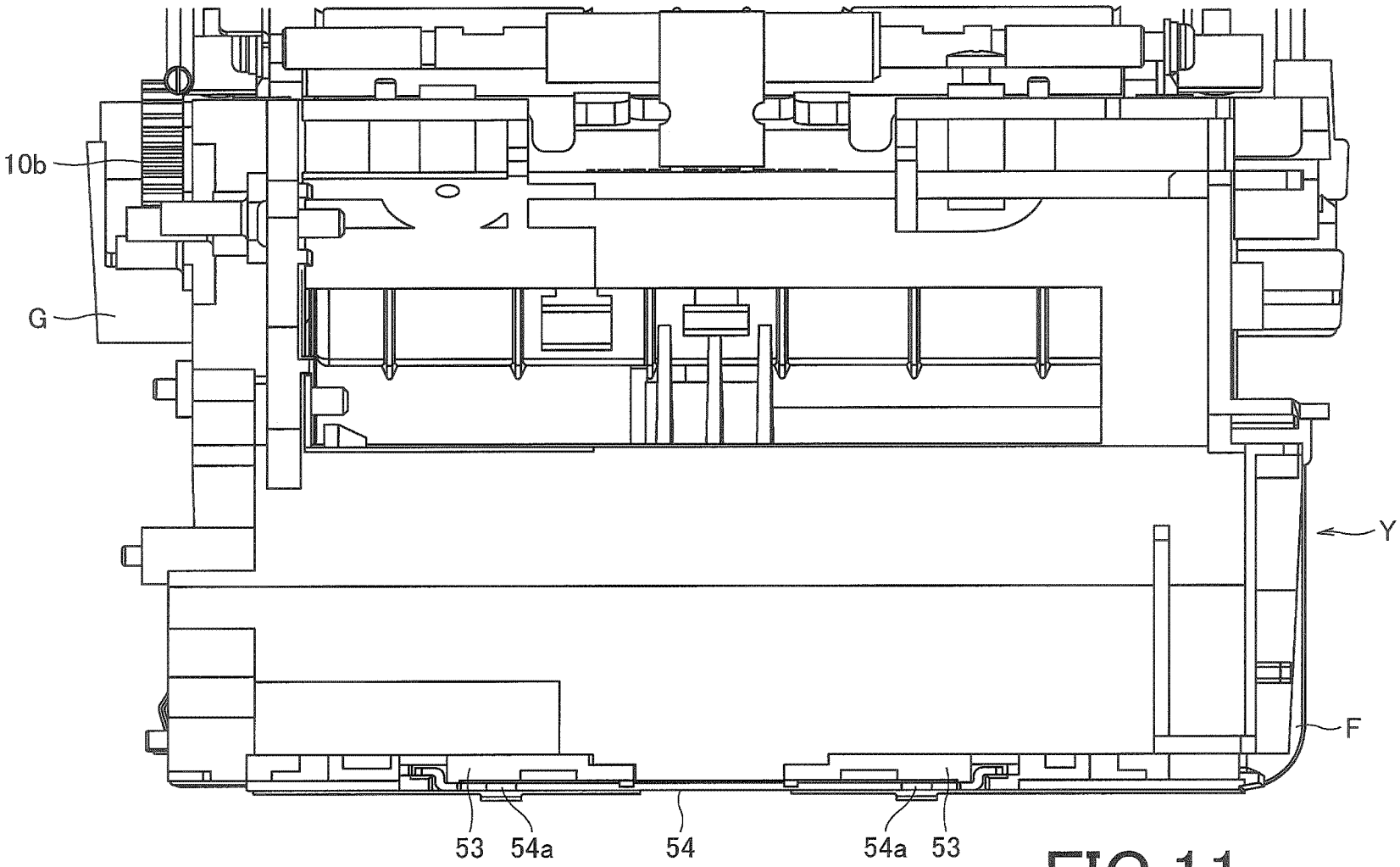
FIG. 11 is a front view of the functional unit of the printer shown in FIG. 1A seen from a direction in which a control board unit is attached to the functional unit.

Next, a structure for attaching the body case 2, the functional unit Y and the front cover 5 to each other will be explained with FIG. 4 and FIGS. 9 to 11. FIG. 9 is a bottom view of the body case. FIG. 10 is a bottom view of the functional unit. FIG. 11 is a front view of the functional unit seen from a direction in which the control board unit is attached thereto.

In the present exemplary embodiment, as described above, the body case 2 and the front cover 5 are fixed to each other by four screws in four positions, whereby a structure of interposing the functional unit Y therebetween is produced.

As shown in FIG. 9, the body case 2 is provided with four screw holes 50 in four positions on the back surface thereof. Screws are inserted in the screw holes 50 so as to fix the body case 2 and the front cover 5 to each other. When described in detail, two screw holes 50*a* (first screw holes) are provided in two positions located on the both transverse ends of a paper container-side part, whereas two screw holes 50*b* (second screw holes) are provided in two positions located on the both transverse ends of a display-side part (i.e., a part located on the opposite side of the paper container 6). It should be noted that two screw through holes 50*c* are provided in two positions located transversely inside the screw holes 50*b*. Screws are inserted through the screw through holes 50*c* in order to attach a printer carrier (e.g., belt clip, shoulder belt, etc.) not shown in the drawings to the printer 1.

As shown in FIG. 4, guide bosses 51*a* and 51*b* are provided in the vicinity of the sidewalls of the opening 2*a* of the body case 2. The guide bosses 51*a* and 51*b* respectively communicate with the screw holes 50*a* and 50*b* and guide the insertion direction of the screws inserted into the screw holes 50*a* and 50*b*.

Additionally, as shown in FIGS. 4 and 10, the frame F composing part of the functional unit Y is provided with ribs 52 (exemplary plate pieces) on the both transverse ends thereof. When the functional unit Y is accommodated in the body case 2, the ribs 52 are configured to make contact with the tip end surfaces of the guide bosses 51*a* corresponding to the screw holes 50*a*. Additionally, each of the ribs 52 is provided with a through hole 52*a*. When inserted into the screw holes 50*a*, the screws protrude from the guide bosses 51*a* and penetrate through the through holes 52*a*.

Moreover, the body case 2 is provided with steps 2*b* on the bottom surface in the opening 2*a*. Each step 2*b* is located in the vicinity of each guide boss 51*b* and has a height higher than the surroundings thereof. Furthermore, the frame F is provided with flanges 53. When the functional unit Y is accommodated in the body case 2, the flanges 53 are respectively configured to make contact with the steps 2*b*.

Therefore, on the paper container side, the body case 2 and the front cover 5 are fixed to each other through the frame F by the screws penetrating the through holes 52*a* of the frame F, while interposing the functional unit Y therebetween. On the other hand, on the display side (the opposite side of the paper container 6), the body case 2 and the front cover 5 are directly fixed to each other by the screws while interposing the functional unit Y therebetween.

Additionally, the accommodated functional unit Y does not make contact at the bottom surface thereof with the body case 2 without any gap. The ribs 52 of the frame F makes contact with the tip ends of the guide bosses 51*a*, while the flanges 53 make contact with the steps 2*b*, thereby producing a gap between the body case 2 and the functional unit Y. It should be noted that a cushioning material may be inserted into the gap in order to absorb drop impact and so forth.

Due to the gap, even if external force such as drop impact is applied, the external force is unlikely to be transferred to the functional unit Y. This is because deformation of the case 2 or so forth is permitted by the gap and absorbs the external force. Consequently, positional displacement by external force becomes unlikely to occur among the components attached to the frame F, and further, the body case 2 can be easily replaced when damaged or broken.

It should be noted that tapping screws, each having a slit on its head, may be used, for instance, as the screws for fixing the body case 2 and the front cover 5 to each other. In this case, when the tip of each tapping screw is gradually screwed and fastened into each of screw receiving holes (not shown in the drawings) provided on the inner side of the front cover 5, a screw groove is gradually formed in each screw receiving hole.

As shown in FIGS. 10 and 11, a carrier mount plate 54 (exemplary carrier mount plate) is attached to the frame F while being bridged over the flanges 53. The carrier mount plate 54 is made of metal and is provided with two screw holes 54*a* in two positions so as to fix the printer carrier (e.g., belt clip, shoulder belt, etc.) to the printer 1 by screws. The screw holes 54*a* are provided in positions opposed to the screw through holes 50*c* provided in the aforementioned body case 2. The screws inserted into the screw through holes 50*c* are fastened into the screw holes 54*a*. As shown in FIG. 11 in detail, the carrier mount plate 54 is fitted at the both lengthwise ends thereof to the frame F, and is thereby elastically deformable as with a plate spring.

Therefore, when the belt clip or so forth is attached to the carrier mount plate 54, vibrations to be transferred to the printer 1 through the belt clip or so forth by the motion of a worker is absorbed to a large extent by elastic deformation of the carrier mount plate 54. Accordingly, vibrations are prevented from being directly transferred to the frame F and the components attached to the frame F (e.g., the opening and closing cover 3, the platen roller 10, the thermal head 28, the separation unit 4, the control board unit 40, etc.). Hence, malfunctions attributed to vibrations from the belt clip or so forth becomes unlikely to occur.

Figure 12A:
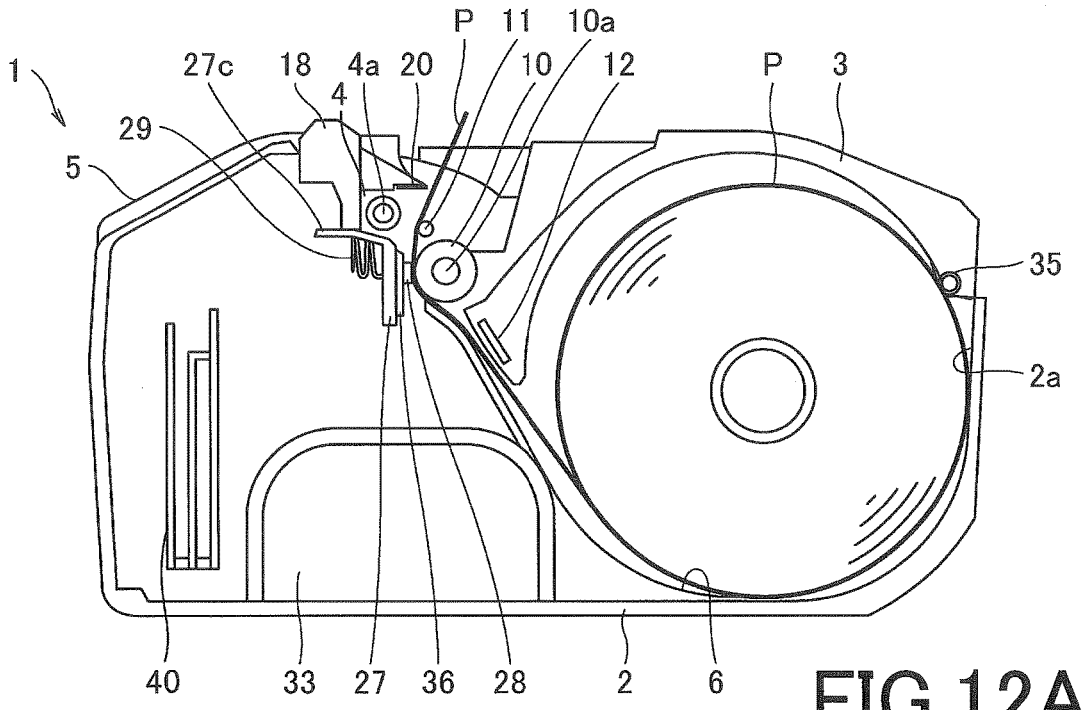
FIG. 12A is a schematic configuration diagram of the printer shown in FIG. 1A in performing continuous ejection.
Figure 12B:
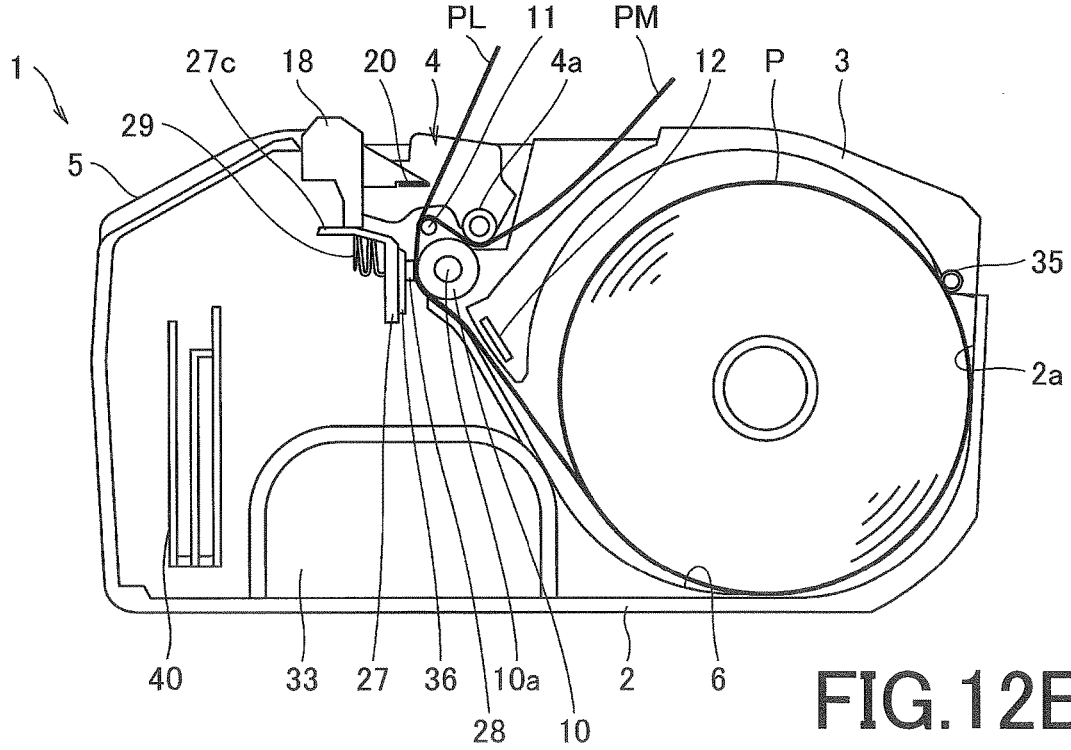
FIG. 12B is a schematic configuration diagram of the printer shown in FIG. 1B in performing separation ejection.

Next, continuous ejection and separation election of the printer 1 will be explained with reference to FIGS. 12A and 12B. FIG. 12A is a schematic configuration diagram of the printer shown in FIG. 1A in performing continuous ejection. FIG. 12B is a schematic configuration diagram of the printer shown in FIG. 1B in performing separation ejection.

In a printing process, regardless of the continuous ejection or separation ejection, the continuous paper P is configured to be fed by rotating the platen roller 10 while the continuous paper P, released from the paper container 6, is pinched between the thermal head 28 and the platen roller 10. While the continuous paper P is being fed, intended information is configured to be printed on the labels PL of the continuous paper P at printing timing set based on the information detected by the sensors 12 by selectively causing the heat elements of the thermal head 28 to generate heat in response to a print signal transmitted to the thermal head 28.

As shown in FIG. 12A, in continuous ejection, the separation unit 4 is herein disposed in the continuous ejection position located in the interior of the printer 1. The printed labels PL are configured to be discharged without being separated from the paper mount PM. In continuous ejection, the paper mount PM to which a necessary number of the labels PL are attached can be prepared, and then the labels PL can be separated from the paper mount PM and be attached to objects on site. Hence, this mode is suitable for a situation where the objects to which the labels PL are to be attached are located away from the printer 1.

On the other hand, in separation ejection, as shown in FIG. 12B, the separation unit 4 is disposed in the separation ejection position, and the paper mount PM is set pinched between the nip roller 4*a* of the separation unit 4 and the platen roller 10 via the separation pin 11. Accordingly, when the continuous paper P is fed for a printing purpose by rotating the platen roller 10, the paper mount PM is configured to be fed while being pinched between the nip roller 4*a* and the platen roller 10, whereas the printed labels PL are configured to be separated from the paper mount PM and be discharged outside the printer 1 one by one. In separation ejection, the labels PL are discharged one by one. Hence, this mode is suitable for a situation where objects to which the labels PL are to be attached are located near a worker.

The printer 1 according to the present exemplary embodiment is capable of switching between continuous ejection and separation ejection, and is solely compatible with two situations where objects to which the labels PL are to be attached are located near the printer 1 and where those objects are located away from the printer 1. Hence, the printer 1 is economical with good usability.

Based on the exemplary embodiment, the present invention made by the inventor of the present application has been specifically explained above. It should be understood that the exemplary embodiment disclosed in the present specification is exemplary only in all aspects and the present invention is not limited to the technology herein disclosed. In other words, the technical scope of the present invention should not be interpreted restrictively based on the explanation in the aforementioned detailed description, rather should be interpreted based on the description of claims, and encompasses equivalents of the technology described in the claims and all the changes made without departing from the gist of the claims.

For example, the aforementioned exemplary embodiment has explained that the present invention is applied to a dual mode printer usable for both of continuous ejection and separation ejection. However, the application of the present invention is not limited to this, and is applicable to a printer usable exclusively for either separation ejection or continuous ejection.

Additionally, the aforementioned exemplary embodiment has explained that a continuous paper in which a plurality of labels are temporarily attached to a paper mount is used as a print medium. However, the print medium is not limited to this. For example, a continuous label having an adhesive surface on one side (mountless label) or a continuously produced sheet without any adhesive surface (continuous sheet) is usable as the print medium, and not only a paper medium but also a film printable by a thermal head or so forth is usable as the print medium. The mountless label, the continuous sheet or the film is capable of being provided with location detection marks. Additionally, in feeding a type of label such as the mountless label on which an adhesive agent is exposed, a feeding path can be coated with a non-adhesive agent and simultaneously a non-adhesive roller containing silicone or so forth can be provided.

INDUSTRIAL APPLICABILITY

In the aforementioned explanation, the present invention has been applied to a stand-alone printer for which an input operation is performed without through a personal computer. However, the application of the present invention is not limited to this. The present invention may be applied to an on-line printer for which an input operation is performed through a personal computer.

The invention claimed is:

1. A printer comprising:

a functional unit including:

a frame having a print medium container configured to contain a print medium, and a rib extending outward from a surface of the frame;

an opening and closing cover pivotally supported by the frame so as to open and close the print medium container;

a feeding roller rotatably supported by the opening and closing cover, the feeding roller configured to feed the print medium; and a print head located to face the feeding roller and configured to print on the print medium when the opening and closing cover is closed;

a first housing; and a second housing, wherein the first housing and the second housing are configured to together contain at least a portion of the functional unit, and the first housing and the second housing are fixed together through the rib.

2. The printer according to claim 1, wherein the functional unit further includes a control board, the control board controlling operations of the feeding roller and the print head.

3. The printer according to claim 2, wherein the control board is attached to the frame.

4. The printer according to claim 2, wherein each of the opening and closing cover, the feeding roller, the print head and the control board are attached to the frame.

5. The printer according to claim 1, wherein a gap is defined between the first housing and the functional unit.

6. The printer according to claim 5, wherein the first housing includes a step located on a surface of the first housing, and the frame further has a flange extending outward from the surface of the frame, the flange being in contact with the step thereby defining the gap.

7. The printer according to claim 5, wherein the first housing includes a guide boss for guiding a screw for fixing the first housing and the second housing together, the rib includes a through hole for the screw to penetrate therethrough, and a tip end of the guide boss makes contact with the rib.

8. The printer according to claim 5, wherein a cushioning material is located in the gap.

9. The printer according to claim 5, further comprising a carrier mount plate that is elastically deformable, the carrier mount plate having a screw hole for fixing a printer carrier thereto, the carrier mount plate being fitted at two ends thereof to the frame.

10. The printer according to claim 1, wherein the frame further has an electric power supply container.

11. The printer according to claim 1, wherein the second housing is provided with a cover open button for opening the opening and closing cover.

12. The printer according to claim 1, wherein the opening and closing cover is attached to the frame.

13. The printer according to claim 1, wherein the feeding roller is attached to the frame.

14. The printer according to claim 1, wherein the print head is attached to the frame.

* * * * *